US011833532B2

(12) United States Patent
Seiss et al.

(10) Patent No.: US 11,833,532 B2
(45) Date of Patent: Dec. 5, 2023

(54) THROTTLE PLATE

(71) Applicant: UNIFIED BRANDS, INC., Jackson, MS (US)

(72) Inventors: Richard Seiss, Madison, MS (US); Michael P. Licata, Lee's Summit, MO (US); Mark Churchill, Grain Valley, MO (US); Tyler Armstrong, Crystal Springs, MS (US)

(73) Assignee: Unified Brands, Inc., Vicksburg, MS (US)

( * ) Notice: Subject to any disclaimer, the term of this patent is extended or adjusted under 35 U.S.C. 154(b) by 657 days.

(21) Appl. No.: 16/794,967

(22) Filed: Feb. 19, 2020

(65) Prior Publication Data

US 2020/0261927 A1 Aug. 20, 2020

Related U.S. Application Data

(60) Provisional application No. 62/860,668, filed on Jun. 12, 2019, provisional application No. 62/807,731, filed on Feb. 19, 2019.

(51) Int. Cl.

| | |
|---|---|
| ***A47L 15/42*** | (2006.01) |
| ***B05B 1/26*** | (2006.01) |
| ***B08B 3/00*** | (2006.01) |
| ***B08B 3/10*** | (2006.01) |
| ***B65D 83/14*** | (2006.01) |
| ***F15D 1/08*** | (2006.01) |

(52) U.S. Cl.

CPC ..... *B05B 1/26* (2013.01); *A47L 15/4214* (2013.01); *B08B 3/006* (2013.01); *B08B 3/102* (2013.01); *B65D 83/753* (2013.01); *F15D 1/08* (2013.01)

(58) Field of Classification Search

None

See application file for complete search history.

(56) References Cited

U.S. PATENT DOCUMENTS

| | | | |
|---|---|---|---|
| 2006/0196528 | A1 | 9/2006 | Jarvis |
| 2017/0224003 | A1 | 8/2017 | Moore et al. |

FOREIGN PATENT DOCUMENTS

| | | | |
|---|---|---|---|
| JP | 2000051133 | A | 2/2000 |
| JP | 2006304991 | A | 11/2006 |
| KR | 10-20100137741 | A | 12/2010 |

OTHER PUBLICATIONS

"International Search Report and Written Opinion for International Application No. PCT/US20/18793, Search completed Jun. 9, 2020, dated Jun. 12, 2020."

*Primary Examiner* — Levon J Shahinian

(74) *Attorney, Agent, or Firm* — Kutak Rock LLP

(57) ABSTRACT

An apparatus and method of restricting entry velocity into a tank is provided. To this end, a throttle plate is utilized to reduce circulation turbulence and significantly reduce the probability of damage to fragile articles undergoing deglazing, defrosting, washing or other circulation within a fluid tank. The throttle plate includes a main body with a top, bottom, and opposing sides and is configured to interface with a wash tank in a variety of throttle plate conditions. The main body of the throttle plate sits substantially against an interior wall of the wash tank, partially obscuring one or more inward flowing jets associated with the wash tank. Such obscuring dampens or throttles the flow of water from the jets into the wash tank. The throttle plate is adjustable; thus, a user of the wash tank can utilize the throttle plate to selectively control the flow of water into the tank.

13 Claims, 14 Drawing Sheets

THROTTLE PLATE

CROSS-REFERENCE TO RELATED APPLICATIONS

This application claims priority pursuant to 35 U.S.C. 119(e) to U.S. Provisional Patent Application Ser. No. 62/807,731, filed Feb. 19, 2019, the entire disclosure of which is incorporated herein by reference, and to U.S. Provisional Patent Application Ser. No. 62/860,668, filed Jun. 12, 2019, the entire disclosure of which is incorporated herein by reference.

FIELD OF THE INVENTION

The present invention relates generally to continuous motion fluid systems. More specifically, the present invention is concerned with a throttle plate for a continuous motion fluid system and associated methods for diverting and/or restricting fluid flow.

BACKGROUND OF THE INVENTION

Continuous motion fluid systems often involve a large tank or basin in which fluid is circulated to provide a rolling action. One such machine is described in U.S. Pat. No. 4,773,436 issued to Cantrell et al., the entire disclosure of which is incorporated herein by reference. The machine of Cantrell includes a tank with multiple jets evenly spaced apart at an elevated position along the rear wall of the tank. The tank is filled with water (or wash fluid) to a level above the position of the jets. Pots and pans (or other items) are placed in the tank, and a pump is activated to draw fluid from within the tank and direct it through the jets to create a jet stream. Each jet directs its jet stream toward the bottom wall of the tank, the bottom wall then deflects the jet stream upward and towards the front wall of the tank. The front wall then deflects the upward moving jet stream towards the rear wall of the tank, and the rear wall deflects the jet stream downward and back towards the front wall along the bottom wall. The combination of deflections of the jet stream from the bottom, front and rear walls provides a rolling action within the tank.

With reference to a ware washing embodiment, the basic components of the wash tank of an exemplary pot and pan washing machine of the prior art are shown in FIG. 1. Wash tank 10 includes end walls 12 and 14, rear side wall 16, front side wall 18 and bottom wall 19. A pump can be attached to either end wall; in the embodiment shown in FIG. 1, pump 50 is attached to right end wall 14. An impeller located within pump 50 is driven by electric motor 56. In the embodiment shown in FIG. 1, the impeller draws fluid into pump inlet 52 through an intake port (not shown) located in end wall 14. The fluid is then discharged from the pump through pump outlet 54 and into outlet manifold 60. Outlet manifold 60 includes a ninety degree turn, and several other turns, to direct the fluid across the back side of rear wall 16 and out jet nozzles 20 which are protruding through and extending from rear wall 16. The intake port associated with pump inlet 52 is covered by perforated (holes, voids, mesh, etc.) intake manifold 30. Intake manifold 30 includes handle 36 and is removably supported within wash tank 10 for easy cleaning. Intake manifold 30 fits tightly between outer runner 32 and inner runner 34, each of which extends vertically from bottom wall 19. Heating element 40 is positioned between intake manifold 30 and end wall 14 for its protection and to maximize the use of space.

Although the prior art pot and pan washing machine disclosed in U.S. Pat. No. 4,773,436 provides an exceptional circulating action, many of the components discussed above hinder the overall efficiency and performance of the machine and/or are not optimized for specific applications. The inventions disclosed in U.S. application Ser. Nos. 09/947,484, 09/947,485, and 10/744,666, the entire disclosures of which are incorporated herein by reference, provide components that greatly increase the overall efficiency and performance of the machine, including improvements to the intake and discharge manifolds, jets, pump, and system assembly methods. Additionally, the invention disclosed in U.S. application Ser. Nos. 12/842,984 and 15/334,778, the entire disclosures of which is incorporated herein by reference, provides components and methods for washing produce (and other items) and defrosting/deglazing items, respectively. Furthermore, U.S. application Ser. Nos. 12/020,223, 12/697,534, 12/765,838, 12/781,750, 13/021,682, 13/080,453, 13/332,360, 13,367,179, 14/276,537, 14/379,190, the entire disclosures of which are incorporated herein by reference, provide additional improvements for the operation of continuous motion style fluid circulating/washing machines. Furthermore still, the inventions disclosed in U.S. application Ser. No. 15/499,221, the entire disclosure of which are incorporated herein by reference, provides components and methods for cleaning various areas of the machine. Nevertheless, prior to the advent of the instant invention, the ability to utilize the fluid circulating style machine in certain circumstances has been limited. For instance, some fluid cycles could benefit from an ability to restrict and/or divert fluid flow from one or more fluid jet, such as when fragile articles undergoing deglazing/defrosting, wash, or other fluid circulation actions within the tank could potentially be damaged by the entry velocity of fluid into the tank and/or the resulting circulation turbulence resulting therefrom. Thus, it would be beneficial to have a system for and method of selectively controlling and/or restricting the entry velocity of fluid into the tank, thereby reducing circulation turbulence resulting therefrom. It would still further be beneficial to have a system for and method of quickly and easily optimizing fluid flow for fragile articles and/or for otherwise adjusting the flow.

SUMMARY OF THE INVENTION

The present invention comprises an apparatus and method of restricting entry velocity into a tank to reduce circulation turbulence and significantly reduce the probability of damage to fragile articles undergoing deglazing, defrosting, washing or other circulation within a fluid tank.

In some embodiments of the apparatus and method, a throttle plate is provided. The throttle plate includes a main body with a top, bottom, and opposing sides. Along the top of the throttle plate a first pair of tabs extend perpendicularly from the main body segment, substantially proximate to the opposing sides. A second pair of tabs extend opposing the first pair, inwardly offset from the first pair of tabs with respect to the opposing sides. The throttle plate is configured to interface with a wash tank in a variety of throttle plate conditions. In a first throttle plate condition, the first set of tabs interface with a wall of a wash tank by hanging from the top of the wall. In this condition, the main body of the throttle plate sits flush against an interior wall of the wash tank, partially obscuring one or more inward flowing jets associated with the wash tank. Such obscuring dampens or throttles the flow of water from the jets into the wash tank. In a second throttle plate condition, the second pair of tabs are utilized to interface with a wall of the wash tank, such that the main body of the throttle plate sits flush against an interior wall while sitting lower than the first throttle condition. In such a configuration, the main body more substantially obscures the aforementioned jets, further throttling the flow of water into the tank. Thus, a user of the wash tank can utilize the throttle plate to selectively control the flow of water into the tank.

In another embodiment of the apparatus and method, a throttle plate is provided that includes a main body with a top, bottom, and opposing sides, and the main body segment includes a bend at a predefined angle. In some such embodiments, the predefined angle is greater than 0 degrees but less than 90 degrees, such that a first portion of the main body is capable of being positioned vertically while a second portion is angled away from vertical. A shelf extends perpendicular from the top of the main body. Utilized in a wash tank, the shelf interfaces with the top of a sidewall of a wash tank, where the first portion of the main body rests substantially flush against a wall of the wash tank and the second portion angles away where the bottom of the throttle plate interfaces with a flow guide surface. Thus, the wall, the throttle plate, and the flow guide surface define three sides to a cavity, in which the throttle plate and flow guide surface form a gate that enables fluid within the cavity to escape when enough pressure builds within the cavity. The wall of the wash tank includes jets that discharge water into the cavity. The flow of water into the tank fills the cavity with fluid and builds pressure in the cavity until the pressure causes the throttle plate to lift slightly from the flow guide surface, introducing a thin, ribbon-like flow into the wash tank along the fluid flow guide surface. Such action reduces the point impacts associated with water entering the wash tank through the jets and lowers the destructive water forces within the wash tank.

The foregoing and other objects are intended to be illustrative of the invention and are not meant in a limiting sense. Many possible embodiments of the invention may be made and will be readily evident upon a study of the following specification and accompanying drawings comprising a part thereof. Various features and subcombinations of invention may be employed without reference to other features and subcombinations. Other objects and advantages of this invention will become apparent from the following description taken in connection with the accompanying drawings, wherein is set forth by way of illustration and example, an embodiment of this invention and various features thereof.

BRIEF DESCRIPTION OF THE DRAWINGS

A preferred embodiment of the invention, illustrative of the best mode in which the applicant has contemplated applying the principles, is set forth in the following description and is shown in the drawings and is particularly and distinctly pointed out and set forth in the appended claims.

It will be appreciated that in other various embodiments, not shown, the height(s) of the THROTTLE PLATE tabs is more and less than the height(s) shown, depending upon the amount of flow interference desired.

Figure 18:
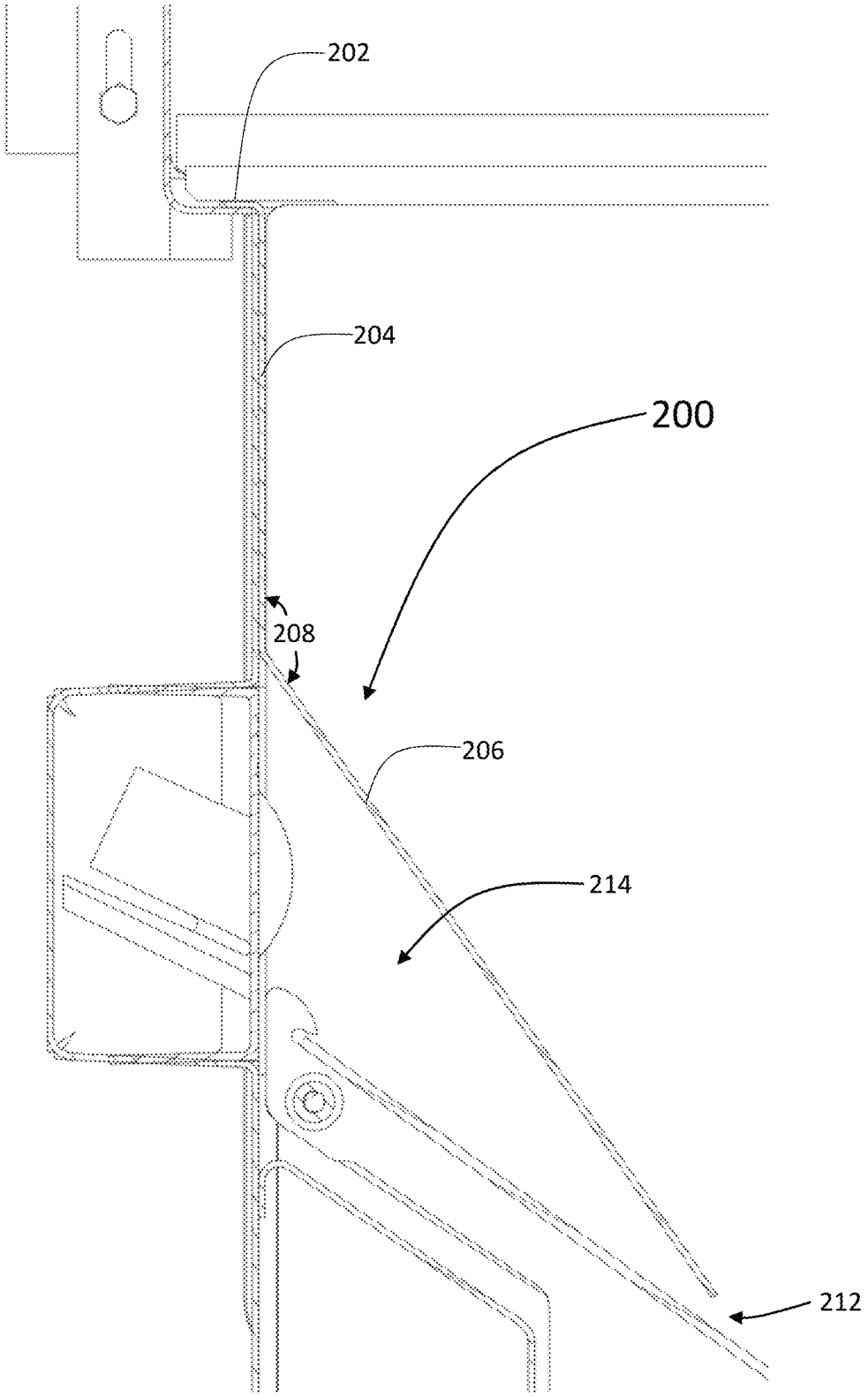
FIG. 18 is a zoomed in left side sectional view as depicted in FIG. 16, including the THROTTLE PLATE of FIG. 8 interacting with the flow guide surface of the tank in an "open" configuration where the jets would provide enough flow force to force fluid between the THROTTLE PLATE and the flow guide surface.

It will be appreciated that in other various embodiments, not shown, the gap between the THROTTLE PLATE and the flow guide surface as depicted in FIG. 18 is larger or smaller than the gap as shown.

DETAILED DESCRIPTION

As required, a detailed embodiment of the present invention is disclosed herein; however, it is to be understood that the disclosed embodiment is merely exemplary of the principles of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
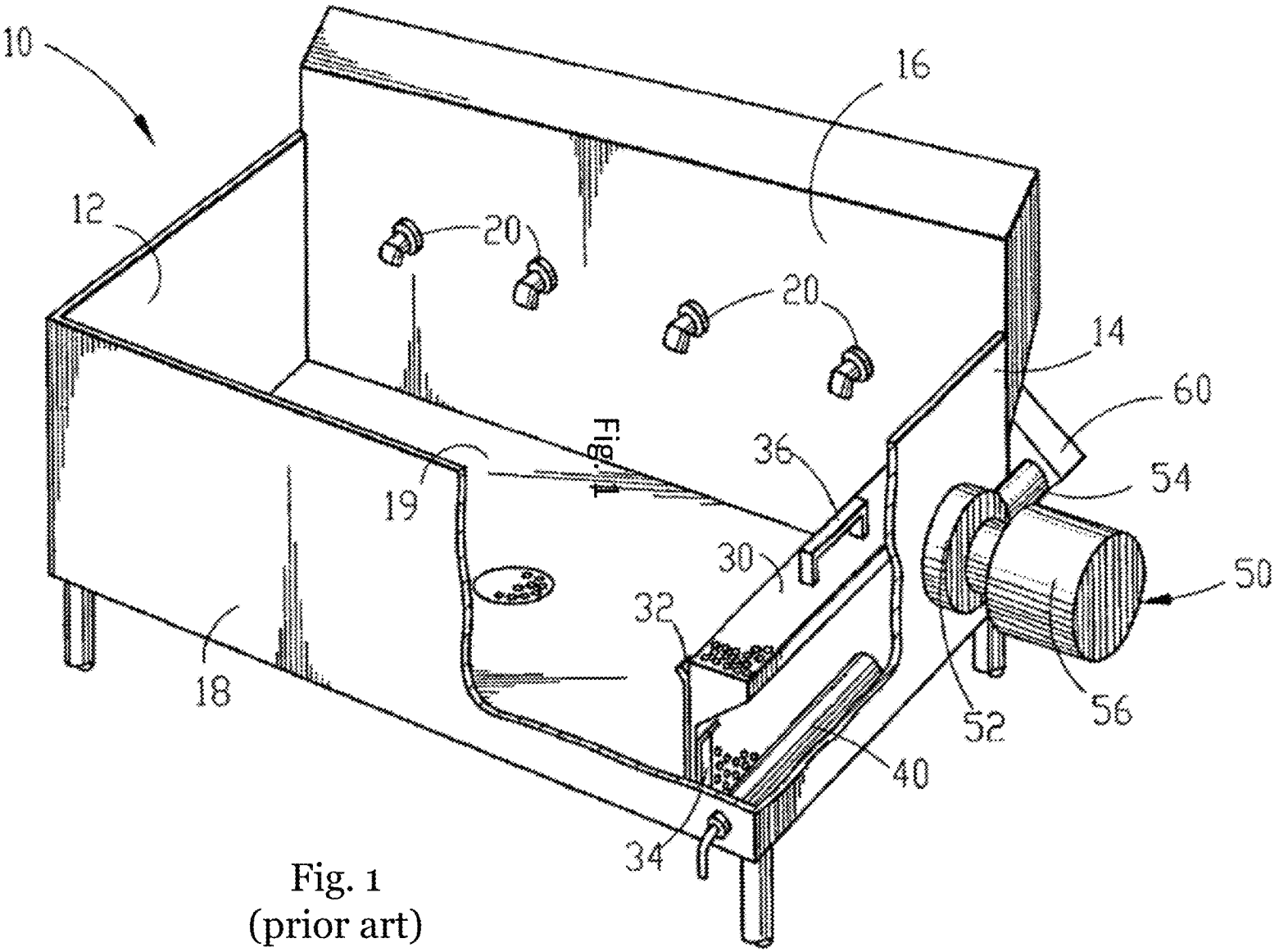
Fig. 1 (prior art)
FIG. 1 is a perspective view of a system of the prior art.
Figure 2:
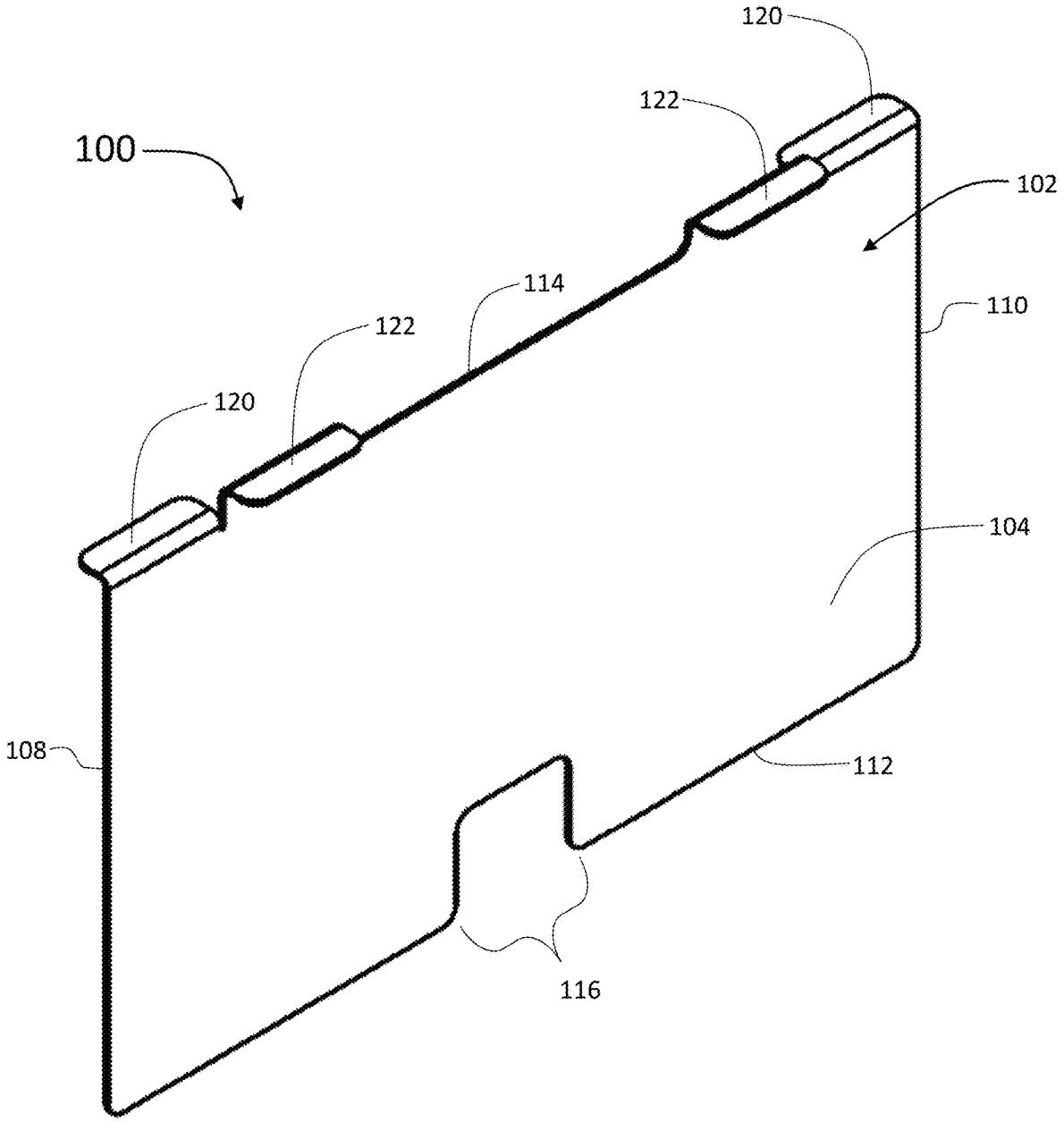
FIG. 2 is a top perspective view of a first embodiment of the THROTTLE PLATE of the present invention.
Figure 3:
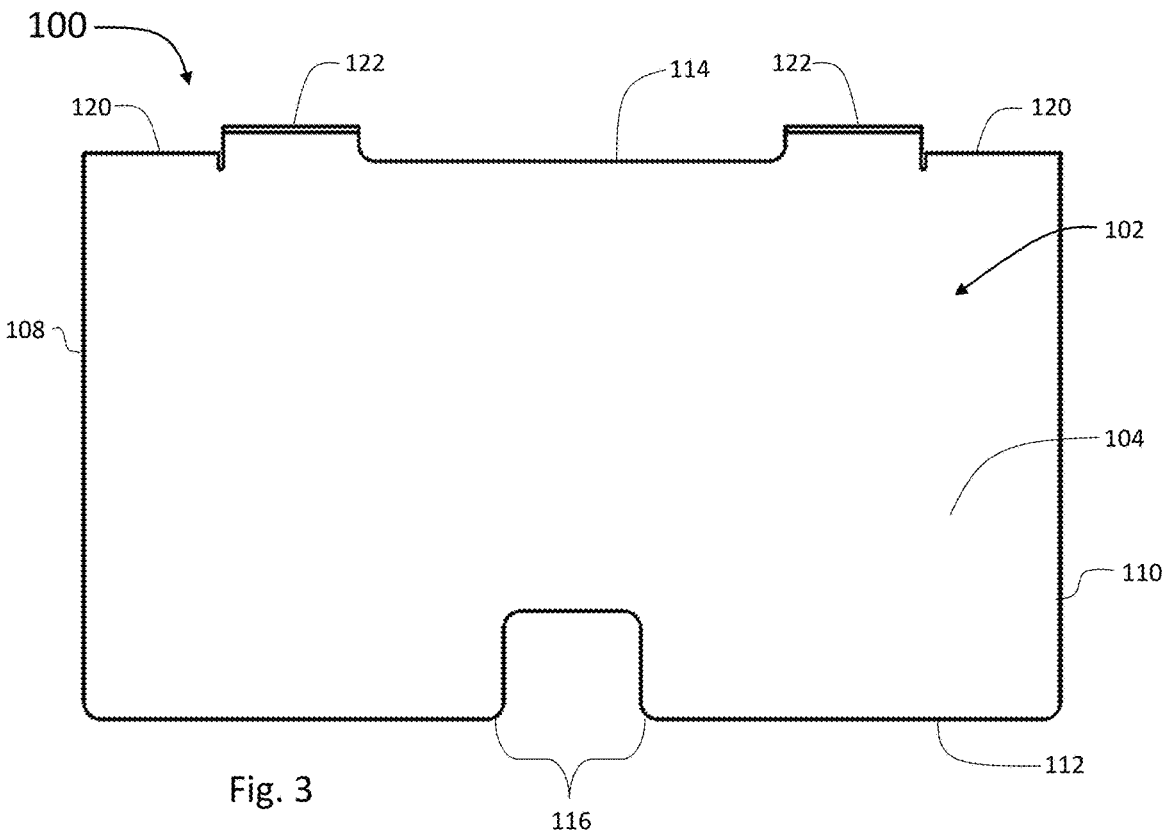
FIG. 3 is a front elevation view of the THROTTLE PLATE of FIG. 1.
Figure 4:
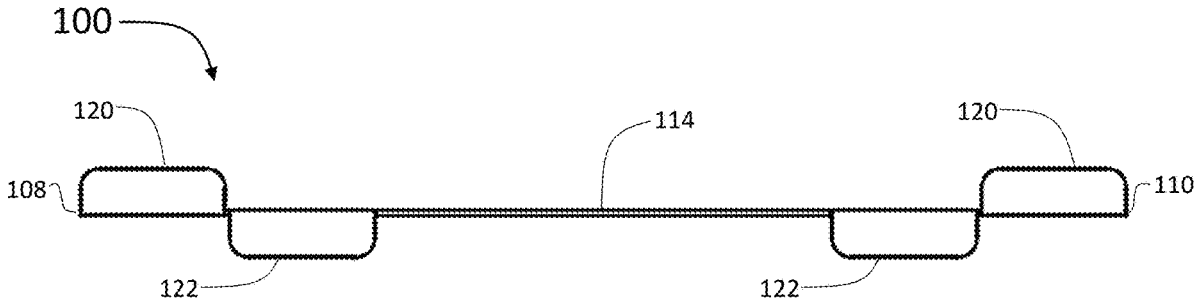
FIG. 4 is a top plan view of the THROTTLE PLATE of FIG. 1.
Figure 5:
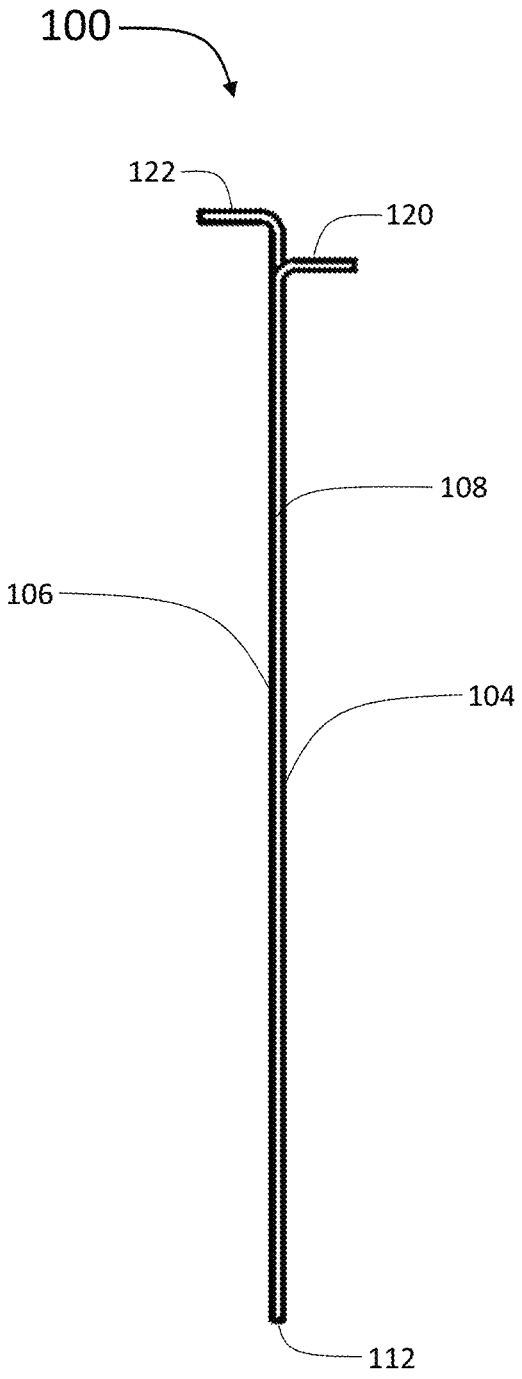
FIG. 5 is a right side elevation view of the THROTTLE PLATE of FIG. 1. The left side elevation view is substantially a mirror image of the right side view shown in FIG. 4.
Figure 6:
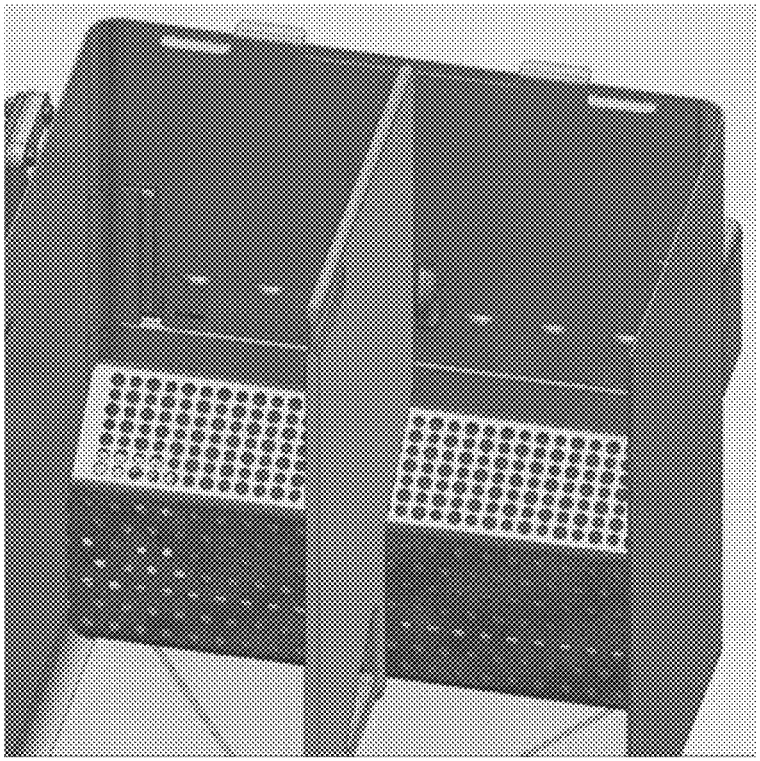
FIG. 6 is a top perspective sectional view of a continuous motion fluid system fluid tank including the THROTTLE PLATE of FIG. 1 in a first configuration.
Figure 7:
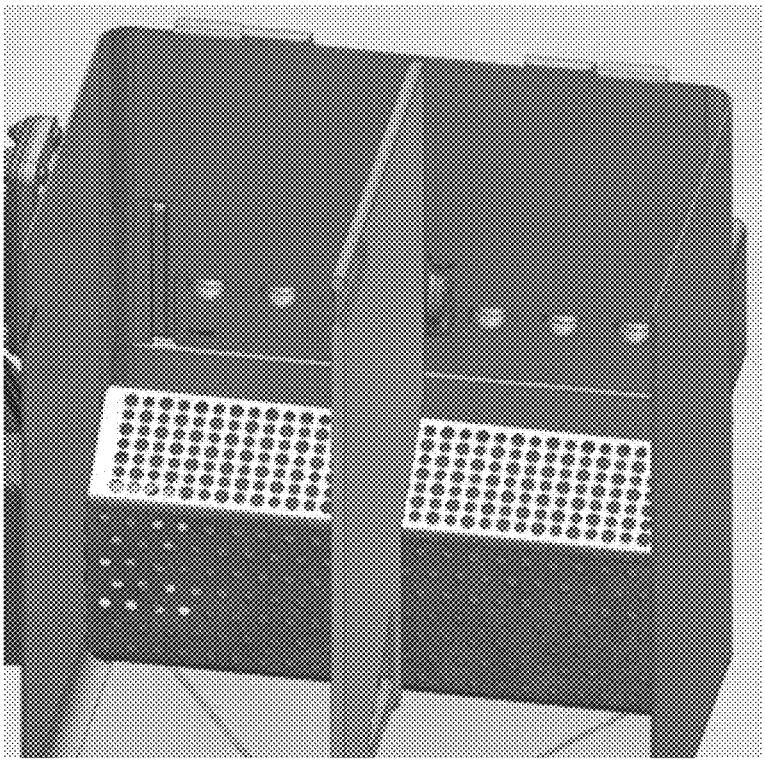
FIG. 7 is a top perspective sectional view of the continuous motion fluid system fluid tank including the THROTTLE PLATE of FIG. 1 in a second configuration.
Figure 8:
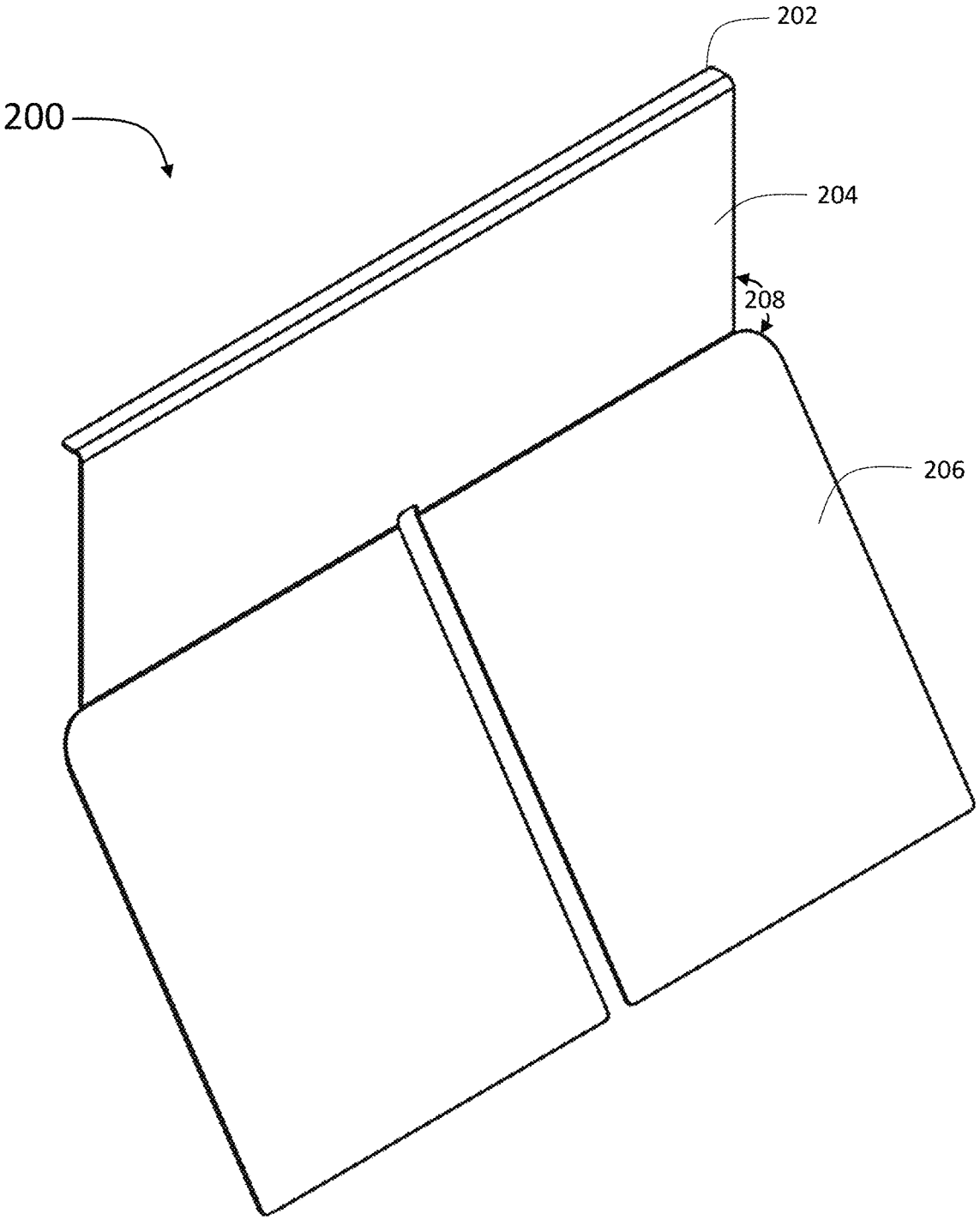
FIG. 8 is a perspective view of a second embodiment of the THROTTLE PLATE of the present invention.
Figure 9:
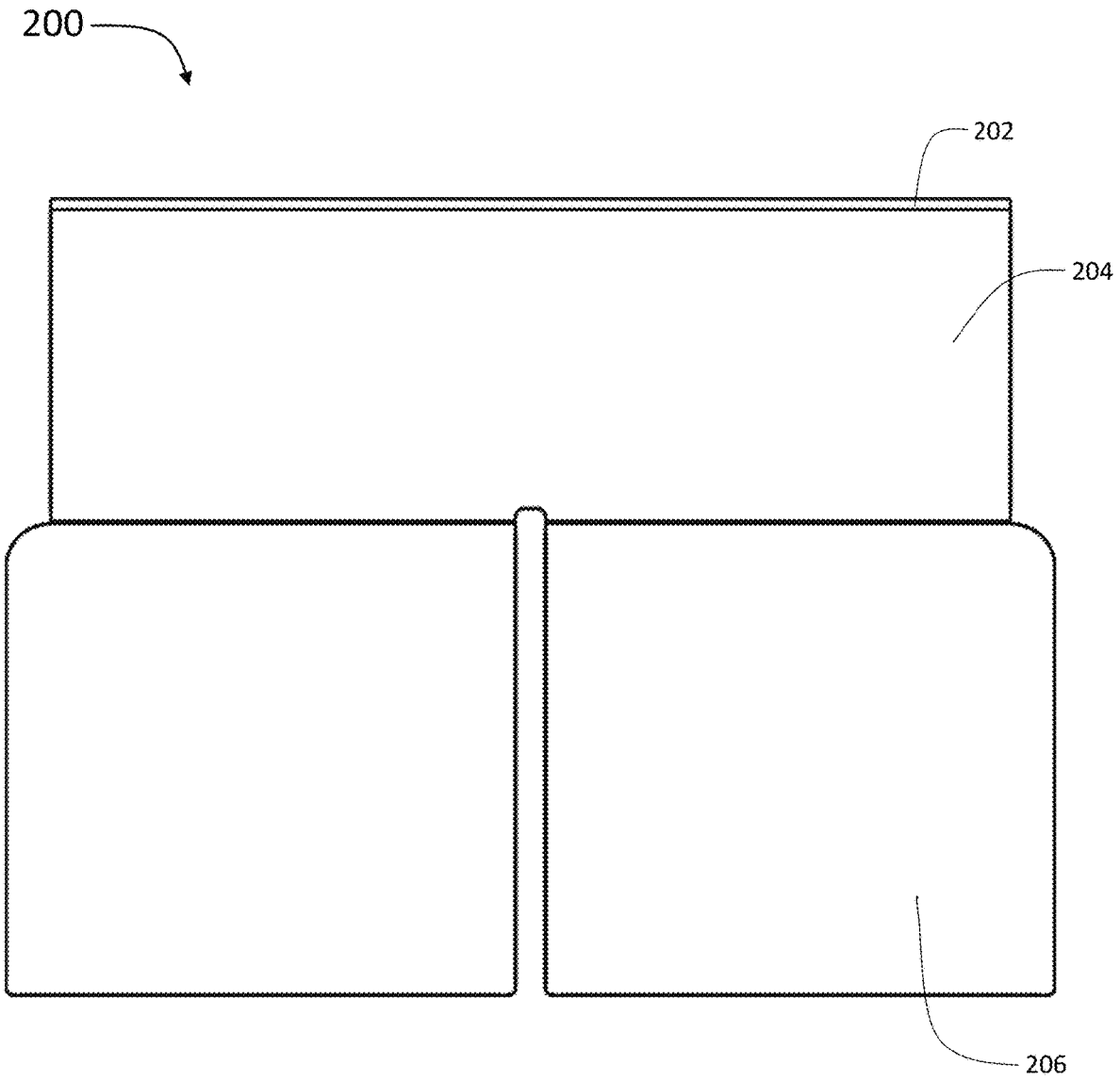
FIG. 9 is a front elevation view of the THROTTLE PLATE of FIG. 8.
Figure 10:
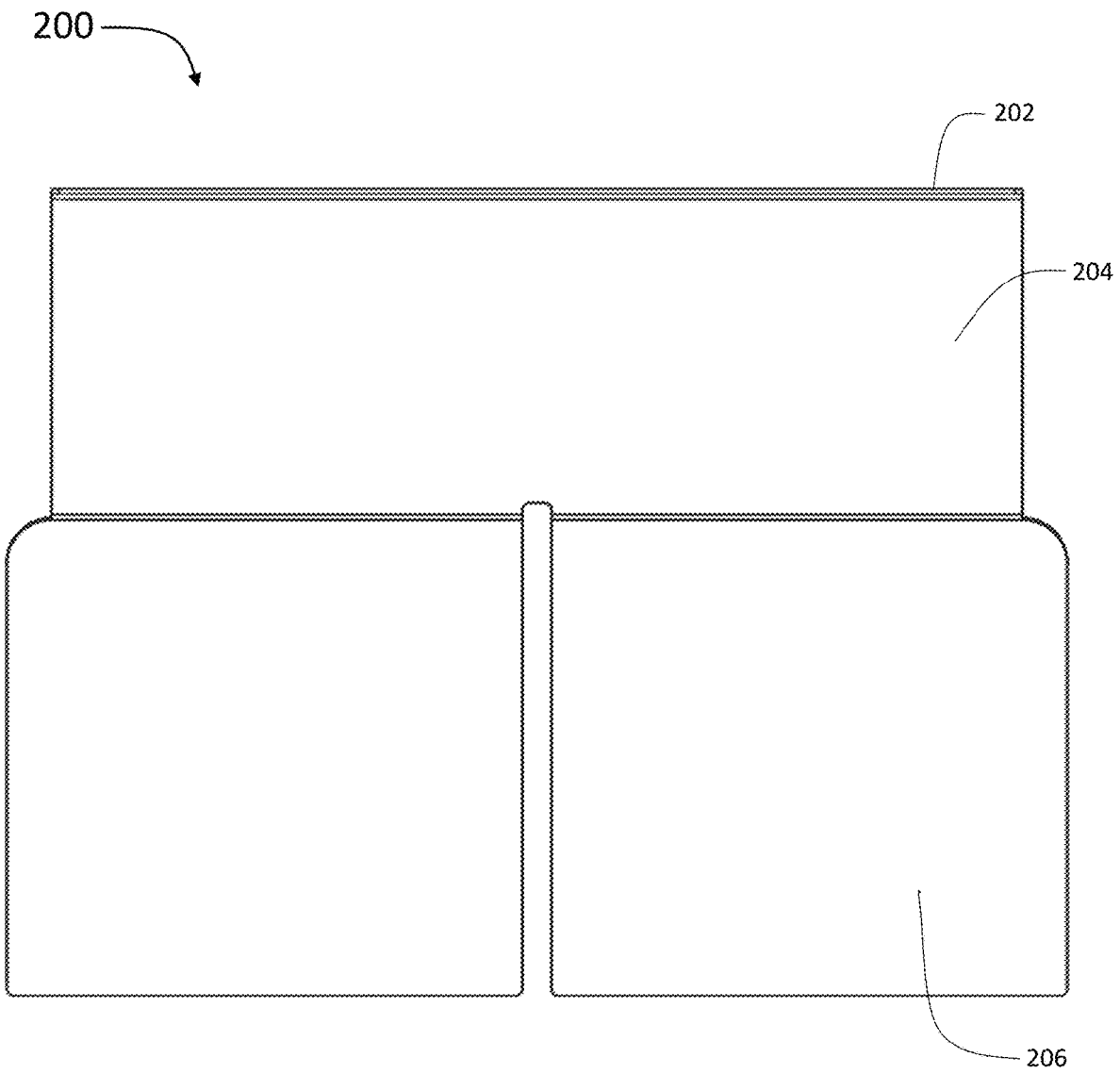
FIG. 10 is a rear elevation view of the THROTTLE PLATE of FIG. 8.
Figure 11:
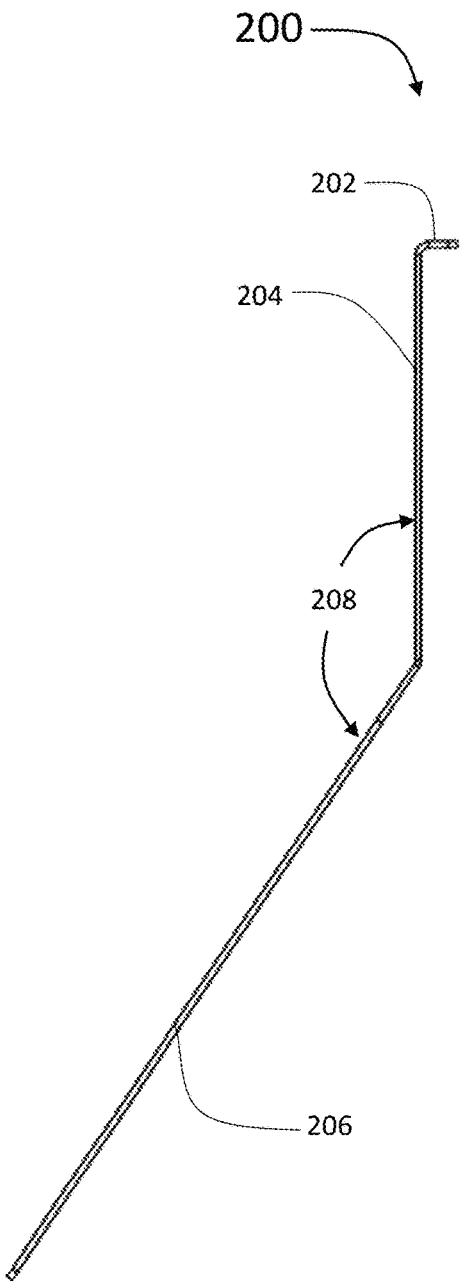
FIG. 11 is a right side elevation view of the THROTTLE PLATE of FIG. 8.
Figure 12:
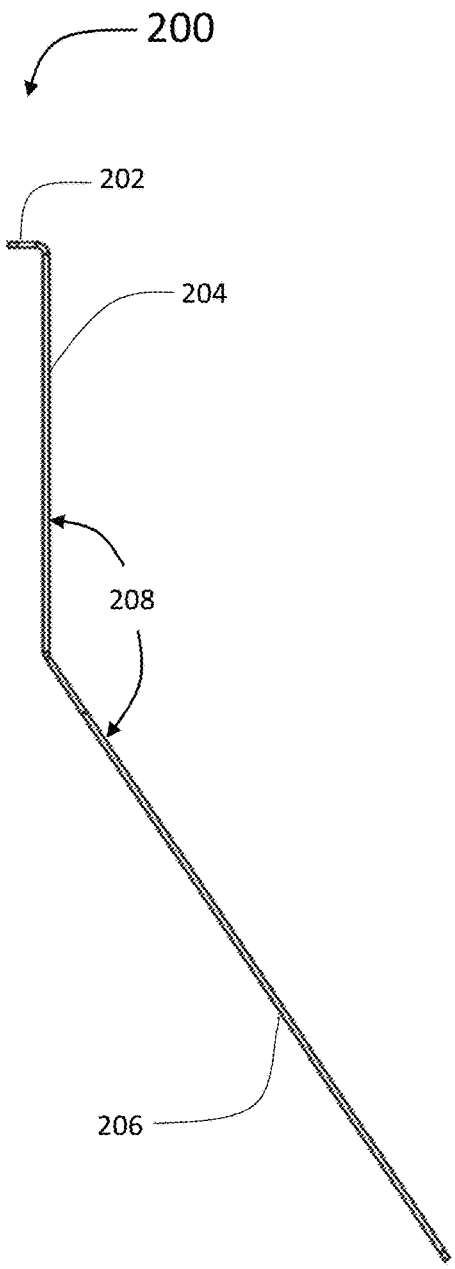
FIG. 12 is a left side elevation view of the THROTTLE PLATE of FIG. 8.
Figure 13:
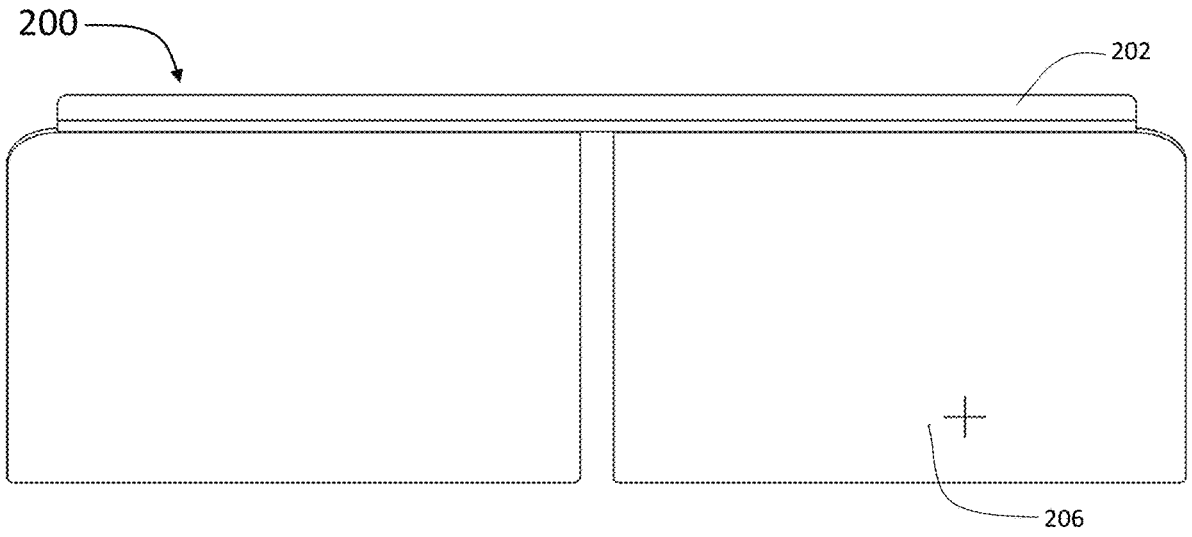
FIG. 13 is a top plan view of the THROTTLE PLATE of FIG. 8.
Figure 14:
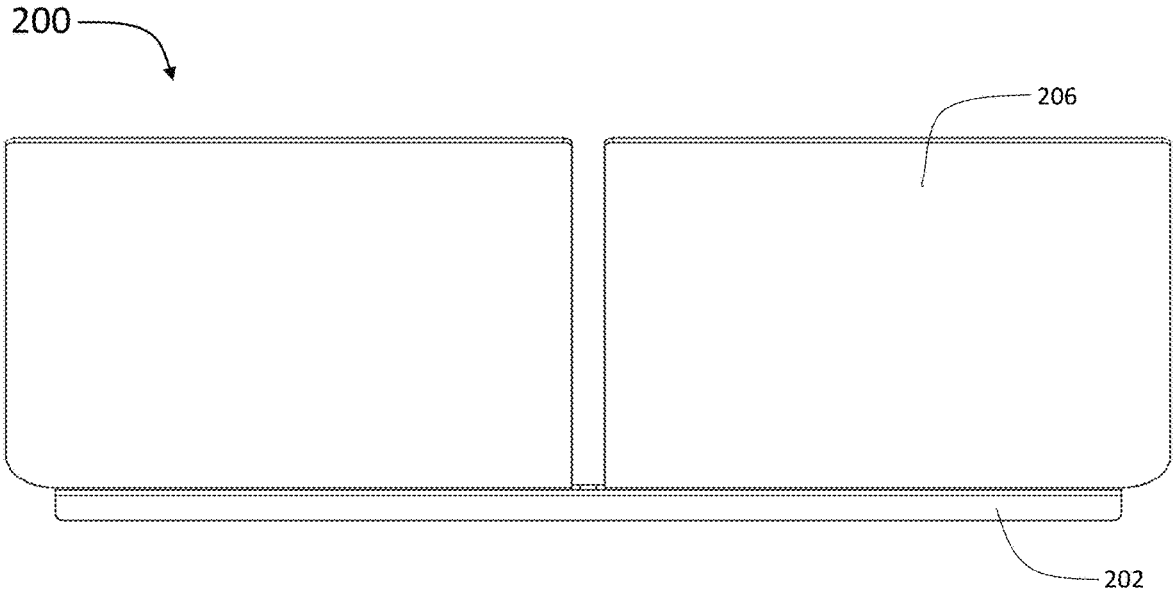
FIG. 14 is a bottom plan view of the THROTTLE PLATE of FIG. 8.
Figure 15:
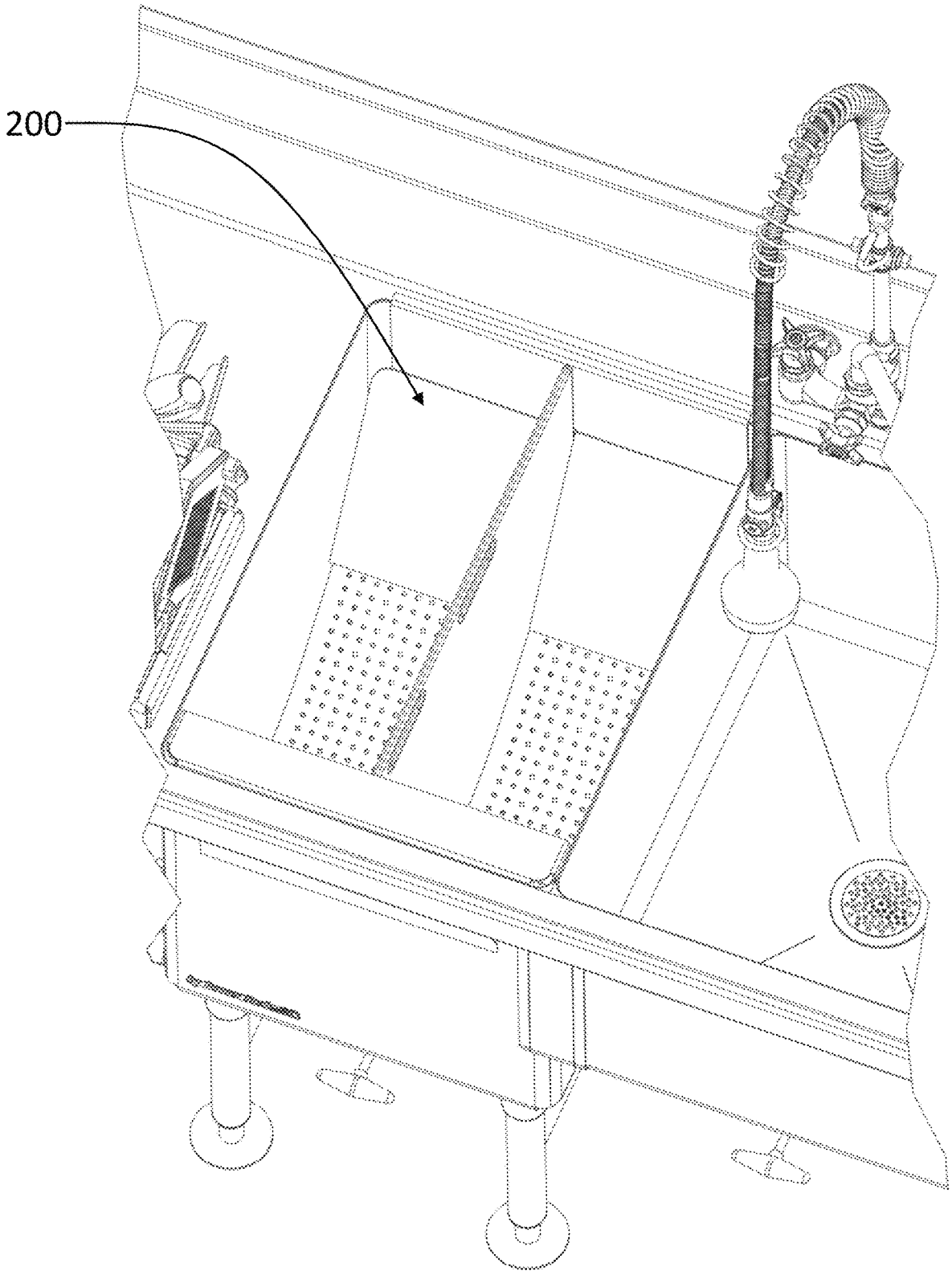
FIG. 15 is a top perspective view of a continuous motion fluid system fluid tank including the THROTTLE PLATE of FIG. 8 interacting with a flow guide surface of the tank.
Figure 16:
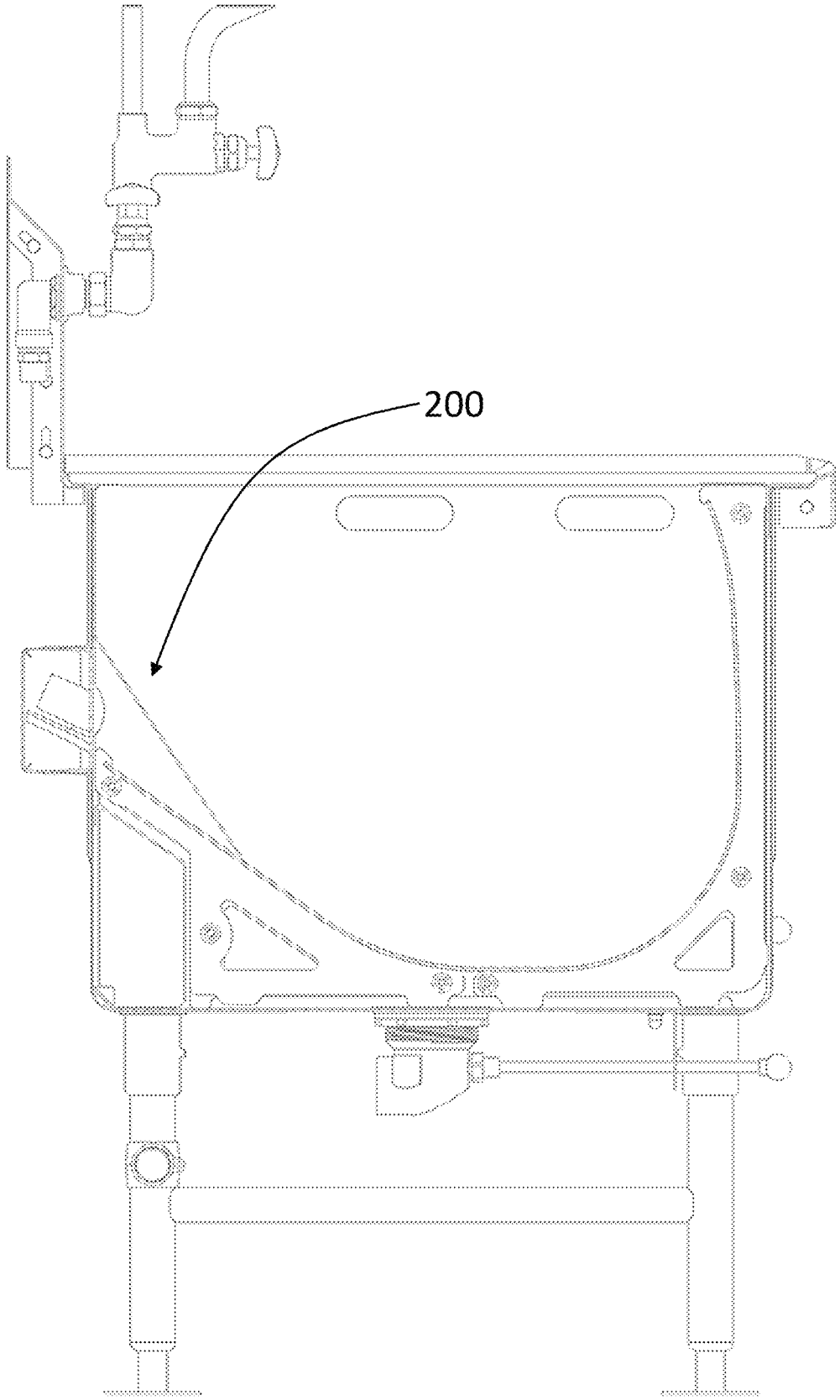
FIG. 16 is a left side sectional view of a continuous motion fluid system fluid tank including the THROTTLE PLATE of FIG. 8 interacting with the flow guide surface of the tank. In this view, the cavity formed by the THROTTLE PLATE of FIG. 8, the flow diverter, and the side of the tank is seen.
Figure 17:
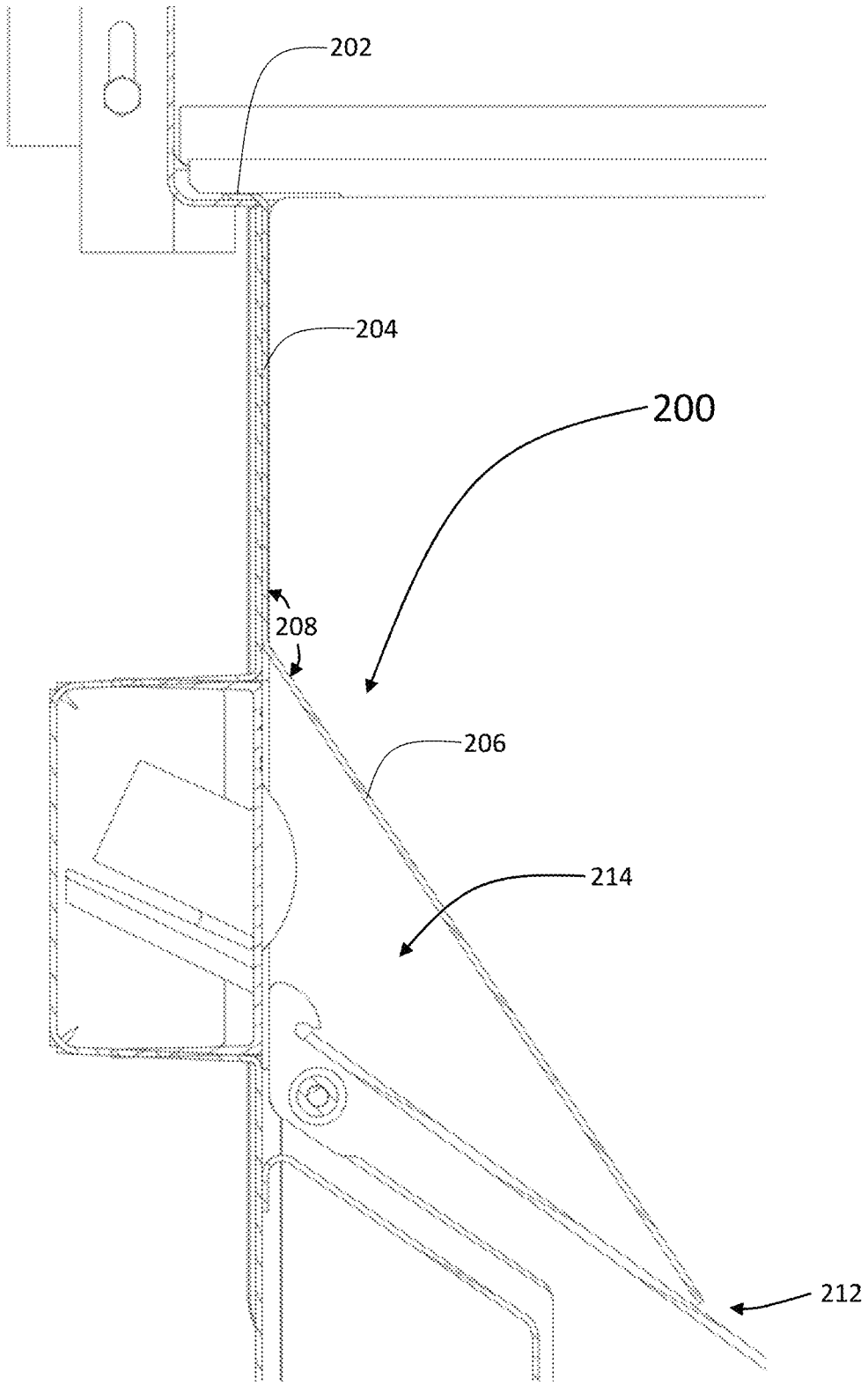
FIG. 17 is a zoomed in left side sectional view as depicted in FIG. 16, including the THROTTLE PLATE of FIG. 8 interacting with the flow guide surface of the tank in a "closed" configuration where the jets would not be providing enough flow force to force fluid between the THROTTLE PLATE and the flow guide surface.

Referring to FIG. 2, some embodiments of the present invention include a throttle plate 100 for selectively impeding and/or otherwise altering flow of fluid into a wash tank ("throttling" the flow). In some embodiments, the throttle plate 100 is moveable to an engaged configuration, such as a first and/or second throttling configuration, by sliding the throttle plate 100 along a back (or other) wall of the wash tank and/or by otherwise engaging the throttle plate 100 with the wash tank. In some embodiments, the throttle plate 100 includes a main body segment 102 that is configured to extend at least partially into one or more discharge jet, thereby throttling such discharge jets. In some embodiments, a first surface of the main body segment 102 defines a first face 104 associated with the first throttling configuration. In some such embodiments, a second surface of the main body segment 102 defines a second face 106 associated with the second throttling configuration. In some embodiments, a first and/or second face 106 of the throttle plate 100 is defined at least partially by one or more edge of the main body segment 102, such as one or more a top, bottom, and/or side edge. In some embodiments, these edges define the entire perimeter of the first face 104 and/or the second face 106.

In some embodiments, the throttle plate 100 is configured such that the main body segment 102 defines a vertical axis when the throttle plate 100 is in an engaged configuration. In some embodiments, the first and/or second face 106*s* are parallel with the vertical axis. In some embodiments, the top edge 114 of the main body segment 102 extends between opposed left 108 and right 110 ends, each of which is associated with a respective left or right edge of the main body segment 102. In some embodiments, the bottom edge 112 of the main body segment 102 is configured to optimize throttling versatility, effectiveness, or the like.

In some embodiments, the throttle plate 100 is formed at least partially from a plastic material, such as polyethylene terephthalate, polyethylene, polyvinyl chloride, polypropylene, polylactic acid, polycarbonate, acrylic, acetal, nylon, acrylonitrile butadiene styrene, and/or a similar material now known or later developed. In some embodiments, the throttle plate 100 is formed at least partially of metal, such as brass, chrome, copper, nickel, pewter, steel, titanium, zinc, an alloy, and/or other metals or combinations of metals now known or later developed. In some embodiments, the throttle plate 100 is formed at least partially of a rubber material and/or one or more other suitable material now known or later developed.

Some throttle plates 100 of the present invention include one or more engagement feature associated with a respective engagement configuration, such as first/primary and/or second/secondary engagement features or the like. In some such embodiments, the first/primary engagement features include a first pair of tabs 120 for selectively engaging with a wash tank (or other feature associated with the wash tank), such as to prevent or otherwise inhibit the throttle plate 100 from extending too far into the wash tank. In some embodiments, one or more engagement feature is configured to provide an indication of whether the throttle plate 100 is in a respective engaged configuration, is configured to assist a user in moving the throttle plate 100 to a respective engaged configuration, is configured to prevent or otherwise inhibit movement of the throttle plate 100 away from the respective engaged configuration, or the like.

Some engagement features of the present invention include one or more tab, such as tab pairs extending laterally from a top edge 114 of the throttle plate 100. In some embodiments, a first tab pair 120 includes a first pair of tab members extending laterally in a first direction. In some embodiments, each tab member of the first tab pair 120 is positioned along the top edge 114 of the main body segment 102 such that the first tab pair 120 provides stability to the throttle plate 100 when it is in the first throttling configuration. In some embodiments, the first tab pair 120 includes opposed left and right tab members positioned proximate respective left 108 and right 110 edges of the top edge 114 of the main body segment 102. In some embodiments, each tab of the first tab pair 120 is bent at an angle, such as 90 degrees. In some embodiments, the angle is less than 90 degrees but more than 0 degrees. In some embodiments, this angle is more than 90 degrees but less than 180 degrees. In some embodiments, the first tab pair 120 is configured to engage a top surface of the wash tank and/or a top edge 114 of the wash tank.

In some embodiments, at least one tab of the first tab pair 120 is formed from the material of the main body segment 102. In some embodiments, at least one tab member of the first tab pair 120 is separately attached or otherwise coupled to the main body segment 102. In some embodiments, each tab has a length, a width, and a height, said length, width, and height defining x, y, and z dimensions of the tabs, respectively. In some embodiments, the dimensions of each tab member of the first tab pair 120 is the same as the dimensions for the other tab member of the first tab pair 120. In some embodiments, the dimensions differ between the tabs of the first tab pair 120.

In some embodiments, the throttle plate 100 includes a secondary engagement feature, such as a second tab pair 122 having a pair of tab members extending laterally in a second direction. In some embodiments, the second direction associated with the second tab pair 122 is opposed to a first direction associated with a first tab pair 120. In some embodiments, each tab member of the second tab pair 122 is located along the top side of the main body segment 102. In some embodiments, each tab member of the second tab pair 122 is located proximate to a respective tab member of the first tab pair 120. In some embodiments, each tab of the second tab pair 122 is bent at an angle, such as 90 degrees. In some embodiments, this angle is less than 90 degrees but more than 0 degrees. In some embodiments, this angle is more than 90 degrees but less than 180 degrees. In some embodiments, the second tab pair 122 is configured to engage a top surface of the wash tank and/or a top edge 114 of the wash tank.

In some embodiments, at least one tab member of the second tab pair 122 is formed from the material of the main body segment 102. In some embodiments, at least one tab member of the second tab pair 122 is separately attached or otherwise coupled to the main body segment 102. In some embodiments, each tab has a length, a width, and height, said length, width, and height defining x, y, and z dimensions of the tabs, respectively. In some embodiments, the dimensions of each tab member of the second tab pair 122 is the same as the dimensions for the other tab member of the second tab pair 122. In some embodiments, the dimensions differ between the tabs of the second tab pair.

In some embodiments, one or more tab member (or other member) of one or more engagement feature is configured to interface with a bin, a sidewall associated with a bin, or the like. In some embodiments, the tab (or other) member defines a face, such as a flat, curved, or other face, thereby facilitating such interface. In some embodiments, the face of one or more tab member is curved towards a first face 104 of the main body segment 102. In other embodiments, the face of one or more tab member is curved away from a first face 104 of the main body segment 102. In some embodiments, one or more curved face tab is configured to interface with a bin, a sidewall associated with a bin, or the like. In some embodiments, the face of one or more tab is bent. In some embodiments, the face of one or more tab is bent towards a first face 104 of the main body segment 102. In some embodiments, the face of one or more tab is bent away from a first face 104 of the main body segment 102. In some embodiments, one or more bent faced tab is configured to interface with a bin. In some embodiments, one or more bent faced tabs is configured to interface with a sidewall associated with a bin. In some embodiments, various tabs are configured to be either flat, curved, and/or bent. In some embodiments, a combination of flat, curved, and/or bent faced tabs are utilized.

In some embodiments, the present invention utilizes one or more removable tabs. In some embodiments, one or more removable tab is associated with a first pair of tabs, such as a first tab pair 120. In some embodiments, one or more removable tab is associated with a second pair of tabs, such as a second tab pair 122. In some embodiments, one or more removable tab is configured to interface with one or more tab receiving aperture (or other feature) defined by (or otherwise associated with) the main body segment 102 of the present invention. In some embodiments, one or more removable tab contains prongs (or other features) that are configured to mate with one or more tab receiving aperture of the main body segment 102. In some embodiments, one or more removable tab member is adjustable and/or interchangeable, such as to allow for optimizing use of such tab members. In some embodiments, one or more tab member is configured so as to be received by any tab receiving aperture of the main body segment 102. In some embodiments, one or more removable tab operates as other tabs described herein after mating with any tab receiving aperture of the main body segment 102.

In some embodiments, the present invention utilizes one or more adjustable tab. In some embodiments, one or more adjustable tab has a variable angle. In some embodiments, one or more adjustable tab is configured to be manipulated and locked at a desirable angle. In some embodiments, one or more adjustable tab has an adjustable length. In some embodiments, one or more adjustable tab is configured to be locked at a desired length. In some embodiments, locking is achieved through a thumbscrew, slide lock, or other locking mechanism now known or later developed.

In some embodiments, a main body segment 102 of the present invention defines one or more aperture 116. In some embodiments, one or more aperture 116 is configured to receive a respective protrusion or the like (each being a "protrusion receiving aperture"). In some embodiments, one or more protrusion receiving aperture 116 extends through the main body segment 102. In some embodiments, one or more protrusion receiving aperture 116 is configured to receive one or more element associated with a wash bin, such as a protrusion.

In some embodiments, the present invention is utilized within a bin to restrict fluid flow. In some embodiments, the bin is a wash tank. In some embodiments, the main body of the throttle plate 100 interfaces against a surface of the tank. In some embodiments, the surface of the tank against which the main body of the throttle plate 100 interfaces defines or is otherwise associated with one or more flow apertures, each such aperture allowing for flow of fluid. In some embodiments, the main body of the throttle plate 100 inhibits fluid flow through one or more flow aperture by obscuring or blocking a portion of the one or more aperture when the throttle plate 100 is in an engaged configuration, such as when an engagement feature of the throttle plate 100 is directly or indirectly engaged with the wash tank, thereby resulting in lower circulating turbulence in the tank when compared with the circulating turbulence in the tank without the presence of the throttle plate 100.

In some embodiments, one or more tabs associated with the throttle plate 100 interface with the bin. In some embodiments, one or more tabs interface with a wall of the tank. In some embodiments, a first pair of tabs secures the throttle plate 100 relative to a wall of a tank. In some embodiments, a first pair of tabs is configured such that the main body of the throttle plate 100 is in frictional contact with a wall of a tank when the first pair of tabs interface with a wall of the tank. It will be appreciated that the height of the throttle plate 100 from each pair of tabs to the bottom edge of the plate (e.g. the edge of the plate generally opposing the tabs) is determined by the distance, "D", from the top edge 114 of the tank surface on which the tabs are configured to rest to the apertures. The height is at least slightly more than D, to inhibit at least a portion of the fluid flow from one or more apertures, and less than D plus the diameter or height of the apertures, to allow some fluid to flow through the inhibited aperture(s).

In some embodiments, the second pair of tabs are offset from the first pair of tabs by some distance along the vertical axis of the main body segment 102. In some embodiments, this vertical offset changes the portion of the one or more aperture which is obscured or blocked by the main body segment 102 of the throttle plate 100 when the second pair of tabs interface with a tank when compared to when the first pair of tabs interface with a tank. Advantageously, this allows for a user to selectively control how much of the apertures are obscured by choosing which pair of tabs to interface with the tank, consequently selectively controlling how much fluid is restricted from flowing through said apertures by the main body of the throttle plate 100. It will be appreciated that the height of the throttle plate 100 from each pair of tabs to the bottom edge of the plate (e.g. the edge of the plate generally opposing the tabs) is determined by the distance, "D", from the top edge 114 of the tank surface on which the tabs are configured to rest to the apertures. The height is at least slightly more than D, to inhibit at least a portion of the fluid flow from one or more apertures, and less than D plus the diameter or height of the apertures, to allow some fluid to flow through the inhibited aperture(s).

In some embodiments, a bottom portion of the throttle plate 100 restricts fluid flow through flow apertures. In some embodiments, such flow apertures are associated with a wash tank. In some embodiments, a bottom edge 112 of the throttle plate 100 bisects flow apertures. It will be appreciated that by bisecting flow apertures, the throttle plate 100 selectively controls total flow rate of fluid moving through the flow apertures. In some embodiments, selectively controlling fluid flow through the flow apertures involves limiting fluid flow through the flow apertures when compared to fluid flow through the flow apertures without the presence of the throttle plate 100.

In some embodiments, a bottom edge 112 of the throttle plate 100 defines a consistent profile along the entire length of such edge. In some embodiments, the throttle plate 100 is configured such that the bottom edge 112 bisects one or more flow aperture. It will be appreciated that by variably vertically positioning the throttle plate 100 and/or by varying distance "D", the throttle plate 100 can be configured and/or reconfigured to obstruct a large amount of flow, a minimal amount of flow, the entirely of the flow, or no flow.

In some embodiments, the bottom edge 112 profile of the throttle plate 100 is inconsistent, thereby containing a variety of edge, ridges, curves, or other geometric features which, alone or in combination with other geometric features, variably disrupts the flow of a fluid. In some embodiments, such variations in the bottom edge 112 profile creates variations in flow of a fluid from flow apertures. It will be appreciated that a wide variety of geometric configurations are employed to precisely control the flow rate and flow distribution in the tank. Moreover, such variations allow for the turbulence and specific flow patterns within the tank to be controlled. For example, one such variation and combination of edge elements creates a flow pattern which is reduced in volume and/or creates a flow around the outside of the wash tank, such that no stream of fluid makes contract with a fragile article inside the tank prior to striking a sidewall of the tank.

In some embodiments, the throttle plate 100 is secured to a bin. In some embodiments, the throttle plate 100 is secured to a sidewall of a wash tank. In some embodiments, the throttle plate 100 is secured within a wash tank. In some embodiments, the throttle plate 100 is secured within a wash tank by way of one or more tabs which interface with a sidewall of a wash tank. In some embodiments, such tabs interfacing with a sidewall of a tank restrict the movement of the throttle plate 100 in at least a vertical direction, such as along a vertical plane relative to the sidewall of a tank. In some embodiments, the throttle plate 100 is held in the tank through a friction interface with elements of the tank. In some embodiments, this friction interface is with a divider of the tank. In some embodiments, this friction interface is along the vertical axis of the main body segment 102 of the throttle plate 100. In some embodiments, this friction interface is defined by multiple contact points. In some embodiments, a protrusion receiving aperture of the main body segment 102 of the throttle plate 100 interfaces and/or receives an element of the wash tank. In some embodiments, this element is defined by the geometry of the wash tank, to which the throttle plate 100 is configured to conform.

In some embodiments, the main body segment 102 of the throttle plate 100 defines pass-through holes. In some embodiments, one or more pass-through hole is configured to partially and/or wholly obscure one or more flow aperture, such obscuring limiting the flow of fluid through one or more flow aperture. In some embodiments, the placement of one or more pass-through hole on the main body of the throttle plate 100 is such that the relative placement of one or more pass-through hole to one or more flow aperture of the tank is the same regardless of which face of the throttle plate 100 is pointed toward the one or more flow aperture and/or which engagement features are being utilized. In some embodiments, the configuration of the placement of one or more pass-through hole on the main body of throttle plate 100 is such that the relative placement of one or more pass-through hole to one or more flow aperture differs depending on which face of the throttle plate 100 is pointed toward the one or more flow aperture and/or which engagement features are being utilized.

In some embodiments, pass-through holes have a circular shape. In some embodiments, pass-through holes have another geometric shape. It will be appreciated that the present invention contemplates pass-through holes which comprise any and all commonly understood geometric configurations, such as, but not limited to, rectangular, triangular, hexagonal, octagonal, or irregular shapes. In some embodiments, the edge of the pass-through holes are flat, regardless of the geometric configuration of the hole shape. In some embodiments, the edges of the pass-through holes have a different geometric profile, such as to modify the characteristics and flow of a fluid passing over the edge.

In some embodiments, the pass-through holes are configured to create a uniform flow across the wash tank when the throttle plate 100 is utilized. In some embodiments, uniform flow is ensured is either a front-facing or rear-facing configuration of the throttle plate 100. In some embodiments, the pass-through holes are configured to strategically create asymmetrical flow within the wash tank. In some embodiments, the asymmetrical flow varies based on whether the throttle plate 100 is in a front-facing or rear facing configuration.

In some embodiments, the throttle plate 100 is adjustable horizontally relative to a wall of a wash tank. In some embodiments, the width of the throttle plate 100 is less than the width of the wash tank. In some embodiments, the throttle plate 100 is configured to interface along the wall of a wash tank at multiple locations. In some embodiments, the throttle plate 100 is configured to slide relative to the wall of a wash tank, such that a throttle plate 100 of width less than the width of a wash tank is positionable at the far end on one side of the wash tank, the far end of an opposing side of a wash tank, or any position there between. It will be appreciated that by adjusting the position of the throttle plate 100 within the wash tank, a throttle plate 100 will strategically obscure and/or bisect one or more flow aperture.

In some embodiments, a single void defines the pass-through hole. In some embodiments, the throttle plate 100 is configured such that the single void obscures no flow apertures when in a first position within the wash tank. In some embodiments, the throttle plate 100 is configured such that the single void obscures one or more flow apertures when in a second position within the wash tank. In some embodiments, adjusting a throttle plate 100 horizontally within the wash bin changes the number of flow apertures which are obscured. In some embodiments, a single void pass-through hole is configured to only partially obscure one or more flow apertures.

In some embodiments, the throttle plate 100 is a stand-alone device. In some embodiments, the throttle plate 100 is integrated into a wash tank. In some embodiments, the throttle plate 100 is stored within the wash tank while in a stowed configuration. In some embodiments, the throttle plate 100 is configurable between a stowed and a deployed (engaged) configuration.

In some embodiments, a portion of the throttle plate 100 is configured to slide within the wash tank, such that a sliding portion of the throttle plate 100 selectively obscures/unobscures one or more flow apertures within the wash tank. In some embodiments, when the sliding portion is configured to unobscure flow aperture within the wash tank, the throttle plate 100 is in a stowed configuration. In some embodiments, when the sliding portion is configured to obscure one or more flow aperture within the tank, the throttle plate 100 is in a deployed configuration.

In some embodiments, the throttle plate 100 is hinged. In some embodiments, one section of the hinged throttle plate 100 is secured to the inside of a wash tank. In some embodiments, a second section of a hinged throttle plate 100 is movable relative to the secured section. In some embodiments, the hinged throttle plate 100 is moveable between a deployed and stowed configuration. In some embodiments, the movable hinged section selectively obscures/unobscures one or more flow apertures within the wash tank. In some embodiments, when the hinged portion is configured to unobscure flow aperture within the wash tank, the throttle plate 100 is in a stowed configuration. In some embodiments, when the hinged portion is configured to obscure one or more flow aperture within the tank, the throttle plate 100 is in a deployed configuration.

In some embodiments, a throttle plate 200 of the present invention includes an intermediate portion 204 extending between a top portion 202 and a bottom portion 206. In some embodiments the throttle plate 200 is moveable between a first position and a second position. In the first position, the throttle plate 200 is displaced from one or more discharge jet such that a discharge stream flowing out of the one or more discharge jet is not affected by the throttle plate 200. In the second position, at least a portion of the throttle plate 200 is positioned proximate to at least one discharge jet such that a discharge stream flowing out of the at least one discharge jet is affected by the throttle plate 200.

In some embodiments, the throttle plate 200 causes the discharge stream to deflect. In some such embodiments, deflecting the discharge stream increases the cross-sectional area of the discharge stream and/or otherwise decreases the velocity of the circulating fluid flow, thereby decreasing impact forces associated with items circulating within the circulating fluid flow. In other such embodiments, deflecting the discharge stream increases the consistency of the circulating fluid flow along a width of the wash tank. In other embodiments, the throttle plate 200 affects the height of the discharge stream and/or diverts the path of the discharge stream.

In some embodiments, the top portion 202 of the throttle plate 200 is configured to selectively secure to a top of a wall of the wash tank, such as the front wall of the wash tank. In some such embodiments, the intermediate portion 204 is configured to extend vertically along the wall of the wash tank towards discharge jets extending through the wall of the wash tank. In some such embodiments, the bottom portion 206 is configured to extend at an angle 208 downward from a bottom edge of the intermediate portion 204 and outward away from the wall of the wash tank. In some embodiments, the angle 208 of the bottom portion 206 of the throttle plate 200 is approximately equivalent to an angle 208 of the discharge jets. In other embodiments, the angle 208 of the bottom portion 206 of the throttle plate 200 is steeper than the angle 208 of the discharge jets such that a jet stream from such discharge jets is deflected upon striking the bottom portion 206 of the throttle plate 200.

In some embodiments, the wash tank includes a fluid flow guide surface. It will be well understood that all references to a fluid flow guide surface contemplate an interior surface of a wash tank. In some embodiments, the interior surface is integrated into the structure of the tank. In some embodiments, the interior surface is an accessory which is removably insertable within the wash tank.

In some embodiments, the bottom portion 206 of the throttle plate 200 interfaces with a fluid flow guide surface. In some embodiments, the interface between the throttle plate 200 and the fluid flow guide surface define a gate 212. In some embodiments, said fluid flow guide surface defines at least one region contoured inconsistently from the contour of at least one corresponding wall of the washing machine wash tank. In some embodiments, the bottom portion 206 of the throttle plate 200 rests upon a fluid flow guide surface such as to define a cavity 214 bounded by the walls of the wash tank, the fluid flow guide surface, and the throttle plate 200.

In some embodiments, when the jets are inactive, the interface between the throttle plate 200 and the fluid flow guide surface defines a closed gate 212. In some embodiments, when the jets are activated, the fluid emanating from the jets fills the cavity 214. In some embodiments, pressure builds within the cavity 214 when the cavity 214 it full and fluid continues to emanate from the jets. In some embodiments, such pressure is insufficient to lift the throttle plate 200 and subsequently open the gate 212. In some embodiments, the pressure inside the cavity is sufficient to lift the throttle plate 200 and open the gate 212.

In some embodiments, where the pressure is great enough to open the gate 212, the throttle plate 200 pivots around the top portion 202 of the throttle plate 200 secured to a top wall of the wash tank. In some embodiments, the throttle plate 200 pivots about a hinge where the top portion 202 and bottom portion 206 of the throttle plate 200 meet.

In some embodiments, such as where the pressure within the cavity 214 causes the secondary variable discharge gate to open, fluid emanates from the gate 212. In some embodiments, the fluid flows along the entire length of the throttle plate 200. In some embodiments, the velocity of the fluid emanated from the open gate 212 is uniform across the entire length of the throttle plate 200. In some embodiments, the uniform velocity is lower than that of the fluid emanating from the discharge jets. In some embodiments, as the pressure increases in the cavity 214 the gate 212 opens proportionally to the increased pressure, such as to facilitate a greater volume of fluid emanating from the gate 212.

In some embodiments, such action by the throttle plate 200 creates a single stream of fluid emanating from the cavity 214, through the gate 212, and into the wash tank. In some embodiments, this action creates a flow which is far less turbulent than would otherwise be present in the wash tank due to direct fluid flow from the jets. In some embodiments, the flow created is wide, thin, and flows along the surface of the fluid flow guide surface. In some embodiments, such transformation of the fluid flow from one or more jets to flow through the gate 212 is an action known as a single stream development.

In some embodiments, the single stream development creates a 'rolling' flow within the wash tank. In some embodiments, such rolling flow includes the wide, thin fluid flow flowing substantially proximate to the fluid flow guide surface as it propagates through the wash tank. In some embodiments, such rolling flow acts to tumble articles in the wash tank without subjecting the articles to extreme point loads which may be experienced from traditional jet discharge flow. In some embodiments, such tumbling action assists in even defrosting/deglazing of articles within the wash tank without harming the articles. In some embodiments, the tumbling objects experience loading moving with the inertia of the tumbling motion.

In some embodiments, the present invention also involves a method of using a throttle plate 200 to restrict flow through the apertures and reduce the circulating turbulence within the tank. In some embodiments, a user positions the throttle plate 200 along an interior surface of a tank such as to restrict flow through apertures in the interior surface by blocking or obscuring said apertures. In some embodiments, a user secures the throttle plate 200 through a friction interface. In some such embodiments, the friction interface is a removable tank divider. In some embodiments, a user selectively chooses how much of the apertures to block or obscure, such as by selectively interfacing the throttle plate 200 to a wash tank by way of one engagement feature 210 of multiple engagement features 210. In some embodiments, a user simply removes the throttle plate 200 when the user wishes to no longer reduce the fluid flow into the tank.

In some embodiments, one or more engagement feature 210, such as a tab member/pair or the like, is utilized to provide vertical and/or lateral support for the throttle plate 200 of the present invention. In some embodiments, at least one engagement feature 210 is located at or near a top portion 202 of the throttle plate 200 while fluid is caused to flow against a bottom portion 206 of the throttle plate 200, thereby creating an overturning moment associated with the throttle plate 200. In some embodiments, one or more engagement feature 210 or other mechanism is utilized to resist the overturning moment, such as by engaging (directly or indirectly) a bottom (or other) portion of the throttle plate 200 with the wash tank. In some such embodiments, the overturning moment is overcome by sliding the throttle plate 200 between a surface of the wash tank and an outer edge of a divider, the outer edge of the divider serving as a means for preventing (or otherwise inhibiting) the throttle plate 200 from rotating away from the surface of the wash tank.

In the foregoing description, certain terms have been used for brevity, clearness and understanding; but no unnecessary limitations are to be implied therefrom beyond the requirements of the prior art, because such terms are used for descriptive purposes and are intended to be broadly construed. Moreover, the description and illustration of the inventions is by way of example, and the scope of the inventions is not limited to the exact details shown or described.

Although the foregoing detailed description of the present invention has been described by reference to an exemplary embodiment, and the best mode contemplated for carrying out the present invention has been shown and described, it will be understood that certain changes, modification or variations may be made in embodying the above invention, and in the construction thereof, other than those specifically set forth herein, may be achieved by those skilled in the art without departing from the spirit and scope of the invention, and that such changes, modification or variations are to be considered as being within the overall scope of the present invention. Therefore, it is contemplated to cover the present invention and any and all changes, modifications, variations, or equivalents that fall within the true spirit and scope of the underlying principles disclosed and claimed herein. Consequently, the scope of the present invention is intended to be limited only by the attached claims, all matter contained in the above description and shown in the accompanying drawings shall be interpreted as illustrative and not in a limiting sense.

Having now described the features, discoveries and principles of the invention, the manner in which the invention is constructed and used, the characteristics of the construction, and advantageous, new and useful results obtained; the new and useful structures, devices, elements, arrangements, parts and combinations, are set forth in the appended claims.

It is also to be understood that the following claims are intended to cover all of the generic and specific features of the invention herein described, and all statements of the scope of the invention which, as a matter of language, might be said to fall therebetween.

What is claimed is:

1. A throttle plate for a continuous motion washing machine, the throttle plate comprising:

a top portion;

a bottom portion; and an intermediate portion extending between said top and bottom portions, wherein said top potion is configured to selectively interface with the washing machine, thereby enabling the throttle plate to move between an engaged configuration and a disengaged configuration, wherein said intermediate portion is configured to extend vertically along a first wall of a wash tank of the washing machine, and wherein said bottom portion is configured to extend at an angle downward and away from a bottom edge of said intermediate portion, and wherein the throttle plate is configured to work in conjunction with a fluid flow guide surface positioned within the wash tank, said bottom portion of the throttle plate being configured to extend towards the fluid flow guide surface so as to define a cavity and a gate, wherein the cavity is defined by the first wall of the wash tank, the fluid flow guide surface, and the throttle plate, and wherein the gate is defined by a distal end of the throttle late and a top surface of the fluid flow guide surface.

2. The throttle plate of claim 1, wherein moving the throttle plate to the disengaged configuration comprises moving said throttle plate away from the washing machine.

3. The throttle plate of claim 2, wherein moving the throttle plate to the engaged configuration comprises positioning at least a portion of the throttle plate proximate to a discharge jet of the washing machine such that a discharge stream flowing out of the discharge jet is affected by the throttle plate.

4. The throttle plate of claim 3, wherein at least a portion of the discharge stream is at least partially deflected by at least a portion of the throttle plate.

5. The throttle plate of claim 4, wherein the deflection changes the cross-sectional area of the discharge stream.

6. The throttle plate of claim 4, wherein the deflection decreases the velocity of circulating fluid associated with the discharge stream.

7. The throttle plate of claim 1, wherein a discharge jet of the washing machine discharges fluid into the cavity.

8. The throttle plate of claim 7, wherein forces associated with discharging fluid into the cavity generate a biasing force for lifting at least a portion of the throttle plate, thereby moving said gate to an open configuration.

9. The throttle plate of claim 8, wherein moving said gate to the open configuration comprises rotating said bottom portion of the throttle plate away from the fluid flow guide surface such that bending stresses are generated in said intermediate portion of the throttle plate.

10. The throttle plate of claim 8, wherein the engagement feature reacts out bending loads associated with the bending stresses, thereby providing a structural support for the throttle plate.

11. A throttle plate for a continuous motion washing machine, the throttle plate comprising:

a main body segment;

a first engagement feature extending laterally from a top edge of said main body segment, wherein said main body segment defines a first face associated with said first engagement feature, and wherein said first engagement feature is a first tab pair extending laterally in a first direction, said first tab pair including opposed left and right tab members positioned proximate respective left and right edges of said top edge of said main body segment, said first tab pair being configured to engage with a top surface of a wash tank of the washing machine, and a second engagement feature associated with a second face of the throttle plate, wherein said second engagement feature comprises a second tab pair extending laterally in a second direction, said second tab pair including opposed left and right tab members positioned proximate to respective left and right tab members of said first tab pair.

12. The throttle plate of claim 11, wherein the throttle plate is moveable between a first configuration and a second configuration associated with the first and second engagement features, respectively, wherein the first engagement feature interfaces with a top surface of the wash tank when the throttle plate is in the first configuration, and wherein the second engagement feature interfaces with the top surface of the wash tank when the throttle plate is in the second configuration.

13. The throttle plate of claim 12, wherein a bottom edge of the throttle plate is configured to bisect one or more flows emanating from one or more discharge jets of the washing machine.

* * * * *